US010595633B2

(12) United States Patent
Allen

(10) Patent No.: US 10,595,633 B2
(45) Date of Patent: Mar. 24, 2020

(54) LOCKER WITH SHOE STORAGE

(71) Applicant: Sam Allen, Maypearl, TX (US)

(72) Inventor: Sam Allen, Maypearl, TX (US)

( * ) Notice: Subject to any disclaimer, the term of this patent is extended or adjusted under 35 U.S.C. 154(b) by 0 days.

(21) Appl. No.: 15/639,216

(22) Filed: Jun. 30, 2017

(65) Prior Publication Data

US 2017/0295928 A1 Oct. 19, 2017

(51) Int. Cl.
*A47B 61/04* (2006.01)
*A47B 61/02* (2006.01)
*A47B 88/42* (2017.01)

(52) U.S. Cl.
CPC ..... *A47B 61/04* (2013.01); *A47B 61/02* (2013.01); *A47B 88/42* (2017.01)

(58) Field of Classification Search
CPC ..... A47B 61/00; A47B 61/003; A47B 61/02; A47B 61/04; A47B 88/42
USPC ..... 312/330.1, 334.24, 334.28, 229, 294; 211/34, 35, 36
See application file for complete search history.

(56) References Cited

U.S. PATENT DOCUMENTS 429,421 A * 6/1890 Coit
483,282 A * 9/1892 Cotton ..... A47L 15/427 15/265
1,281,923 A * 10/1918 Fales ..... A47B 88/42 312/317.2
1,524,704 A * 2/1925 Fore ..... A47K 10/04 211/88.01
2,710,241 A * 6/1955 Lieberman ..... A47B 47/05 108/106
2,923,584 A * 2/1960 Broderick, Jr. ..... A47B 53/00 312/317.1
3,270,891 A * 9/1966 Briggs ..... A47F 5/00 248/220.31
3,411,633 A * 11/1968 Magnuson ..... A47G 25/06 211/106.01
3,737,131 A * 6/1973 Larson ..... A47F 5/0823 211/70.6
4,456,316 A * 6/1984 Lundgren ..... A47B 61/04 312/229
4,460,094 A * 7/1984 Schoen ..... A47G 25/005 211/35
4,699,267 A * 10/1987 Burke ..... A45C 3/12 190/13 F (Continued)

FOREIGN PATENT DOCUMENTS

GB 2394271 * 4/2004

OTHER PUBLICATIONS

Oklahoma University—Gaylord Family—Oklahoma Memorial Stadium Expansion & Renovation—Construction Documents—Nov. 13, 2015 (Combined_Architecturals-_BP7.pdf (Multiple Files)—p. 8).

(Continued)

*Primary Examiner* — James O Hansen
(74) *Attorney, Agent, or Firm* — James E. Walton

(57) ABSTRACT

An enclosure for the storage of shoes includes a pair of spaced-apart, generally opposing end walls. A projection is carried by each of the end walls, each projection is dimensioned and configured to be inserted into the interior of one of a pair of shoes to temporarily secure the shoe in a fixed position relative to the end wall. A bottom extends between the end walls, and includes a removable tray to catch debris falling from the shoes.

16 Claims, 2 Drawing Sheets

(56) References Cited

U.S. PATENT DOCUMENTS

| | | | | | |
|---|---|---|---|---|---|
| 4,753,495 | A * | 6/1988 | Swink | A47F 5/02 | 211/163 |
| 5,228,760 | A * | 7/1993 | Rydell | A47B 81/00 | 232/1 B |
| 5,468,063 | A * | 11/1995 | Simonek | A47B 88/42 | 312/287 |
| 5,687,856 | A * | 11/1997 | Kendrena | A47F 5/0846 | 211/65 |
| 6,119,871 | A * | 9/2000 | Mengel | A47F 7/08 | 211/117 |
| 6,135,584 | A * | 10/2000 | Happ | B25H 3/028 | 312/330.1 |
| 6,513,889 | B1 * | 2/2003 | Park | A47B 81/02 | 312/206 |
| 8,025,347 | B1 * | 9/2011 | Solis | A47L 13/51 | 312/206 |
| 8,733,865 | B1 * | 5/2014 | Chambers | A47B 88/42 | 312/334.24 |
| 2002/0027402 | A1 * | 3/2002 | Hanser | A47B 96/00 | 312/206 |
| 2006/0091087 | A1 * | 5/2006 | Belanger | A47B 61/04 | 211/37 |
| 2006/0220502 | A1 * | 10/2006 | Williams | A47B 61/02 | 312/108 |
| 2007/0278914 | A1 * | 12/2007 | Verfaillie | A47B 88/42 | 312/226 |
| 2008/0224581 | A1 * | 9/2008 | Minerva | A47B 97/00 | 312/229 |
| 2009/0039747 | A1 * | 2/2009 | Webster, II | A47B 61/04 | 312/334.1 |
| 2010/0201230 | A1 * | 8/2010 | Schweitzer, III | H02B 1/50 | 312/107 |
| 2016/0007744 | A1 * | 1/2016 | Fasino | A47F 3/06 | 312/330.1 |
| 2016/0128474 | A1 * | 5/2016 | Chen | A47B 88/956 | 312/333 |

OTHER PUBLICATIONS

Oklahoma University—Gaylord Family—Oklahoma Memorial Stadium Expansion & Renovation—Construction Documents—Nov. 13, 2015 (Combined_Architecturals-_BP7.pdf (Multiple Files)—p. 16).

Oklahoma University—Gaylord Family—Oklahoma Memorial Stadium Expansion & Renovation—Construction Documents—Nov. 13, 2015 (Combined_Architecturals-_BP7.pdf (Multiple Files)—p. 163).

Oklahoma University—Gaylord Family—Oklahoma Memorial Stadium Expansion & Renovation—Construction Schedule—Nov. 12, 2015 (Bid_Package_030r1_-_Football_lokers_2015-12-22.pdf—p. 8).

Oklahoma University—Gaylord Family—Oklahoma Memorial Stadium Expansion & Renovation—Construction Schedule—Nov. 12, 2015 (Bid_Package_030r1_-_Football_lokers_2015-12-22.pdf—p. 17).

Oklahoma University—Gaylord Family—Oklahoma Memorial Stadium Expansion & Renovation—Construction Schedule—Nov. 12, 2015 (Bid_Package_030r1_-_Football_lokers_2015-12-22.pdf—p. 40).

Oklahoma University—Gaylord Family—Oklahoma Memorial Stadium Expansion & Renovation—Construction Schedule—Nov. 12, 2015 (Bid_Package_030r1_-_Football_lokers_2015-12-22.pdf—p. 41).

Oklahoma University—Gaylord Family—Oklahoma Memorial Stadium Expansion & Renovation—Populous 14.3886.10—Nov. 13, 2015 (10_51_13_-_metal_lockers.pdf—p. 4).

Oklahoma University—Gaylord Family—Oklahoma Memorial Stadium Expansion & Renovation—Various Construction Documents—Dec. 28, 2015 (Screen_Shot_2015-12-28_at_10.52.41.pdf).

Oklahoma University—Gaylord Family—Oklahoma Memorial Stadium Expansion & Renovation—Various Construction Documents—Dec. 28, 2015 (Screen_Shot_2015-12-28_at_10.52.57.pdf).

Oklahoma University—Gaylord Family—Oklahoma Memorial Stadium Expansion & Renovation—Various Construction Documents—Dec. 28, 2015 (Screen_Shot_2015-12-28_at_10.53.11.pdf).

Oklahoma University—Gaylord Family—Oklahoma Memorial Stadium Expansion & Renovation—Various Construction Documents—Dec. 28, 2015 (Screen_Shot_2015-12-28_at_10.53.16.pdf).

Oklahoma University—Gaylord Family—Oklahoma Memorial Stadium Expansion & Renovation—Populous 14.3886.10 Section 10 51 16—Wood Lockers, Nov. 13, 2015 (OU4_10_51_16_-_wood_lookers.pdf).

Oklahoma University—Gaylord Family—Oklahoma Memorial Stadium Expansion & Renovation—Populous 14.3886.10—Nov. 13, 2015 (10_51_13_-_metal_lockers.pdf).

Oklahoma University—Gaylord Family—Oklahoma Memorial Stadium Expansion & Renovation—Populous 14.3886.10 Section 10 51 13—Casework Details, Nov. 13, 2015 (OU4_A8-7-8_-_2015-12-11_-_BP_07_ADD-02.pdf).

* cited by examiner

LOCKER WITH SHOE STORAGE

BACKGROUND

1. Field of the Invention

The present invention relates generally to improvements in lockers or storage cabinets used in athletic or sporting facilities, and more specifically to compartments within such lockers configured and adapted especially for storing shoes.

2. Description of Related Art

The aesthetics and utility of lockers or storage cabinets in "locker rooms" of athletic and sporting facilities of sports teams and country clubs, for example, have become a measure of the quality and prestige of such organizations and an increasingly important aspect of recruiting new team or club members. Modern lockers are a far cry from the simple wood or metal cabinets of the past.

Modern lockers may incorporate storage for specific items of equipment, such as helmets and shoes, and features promoting comfort and luxury. One consistent problem in locker rooms of all types is the storage of wet, muddy, or dirty athletic or sporting shoes, such as football cleats, basketball shoes, or golf spikes. Conventional storage compartments may not promote proper or adequate ventilation or drying and become filled with debris falling from the shoes. This is but one problem confronted in locker design. There is a constant need for improvement in this and other aspects of such lockers.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
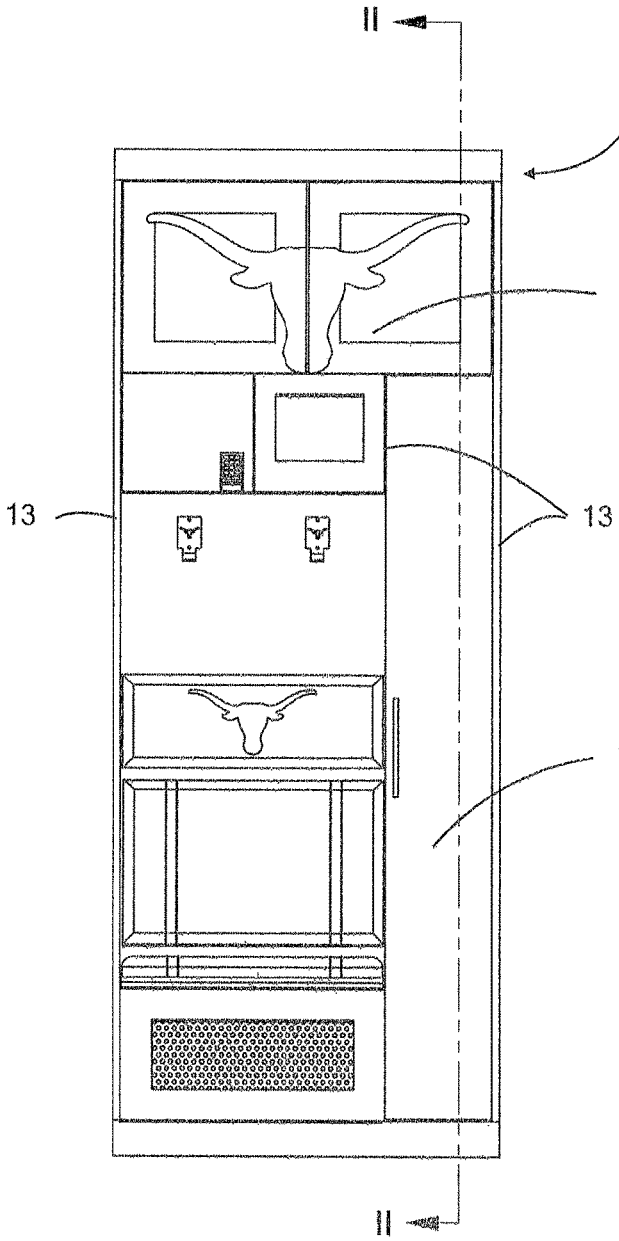
FIG. 1 is a front elevation of a locker incorporating the shoe storage enclosure according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the locker according to the present application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
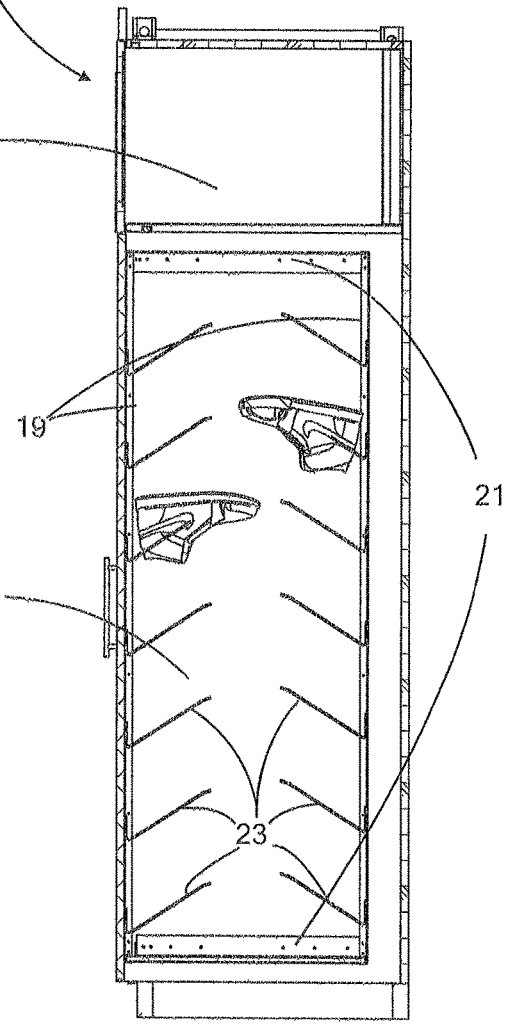
FIG. 2 is a side section view, taken along the section line II-II of FIG. 1.

Referring now to FIGS. 1 and 2 in the drawings, a locker 11 according to an embodiment of the present application is depicted. Locker 11 comprises a pair of upstanding sidewalls 13 that generally define the extent of the locker. Each locker 11 may be installed adjacent to another, similar or identical locker, with its rear against a wall, and its front facing the interior of the locker room.

Between the sidewalls 13 of locker 11, a plurality of compartments 15 are defined by shelves or other horizontally extending surfaces or platforms. As used herein, "sidewall" or "sidewalls" may refer to either "main" sidewalls 13 or other upstanding or generally vertical sidewalls arranged between the "main" sidewalls. Multiple additional sidewalls may be placed between the "main" or exterior sidewalls 13 to define compartments 15 in cooperation with shelves. Each compartment 15 may be sized and otherwise configured for storage of clothing or sporting equipment or other items and may include at least one door, which may be lockable.

Among the compartments in locker 11 according to the present application is a shoe-storage compartment 17. Shoe-storage compartment 17 includes a pair of spaced-apart, opposed or opposing front and rear end walls 19, which are connected at the top 20 and bottom. Heavy-duty drawer slides 21 may be mounted at the top and bottom of end walls 19 and are secured to the interior of sidewalls 13 to permit the enclosure to slide or move between open or extended (see FIG. 3) and closed or retracted positions (as shown in FIGS. 1 and 2). The slides may be located elsewhere along the vertical dimension of compartment 17, as well. Compartment 17 may vary in height, width, and depth but should be large enough in all dimensions to accommodate at least one pair of shoes and preferably two or more pairs. Compartment 17 may be provided with a lamp in the form of LED lights or other illumination sources. Such a lamp may be provided with switches that turn it on or off as compartment 17 is opened and closed.

Figure 3:
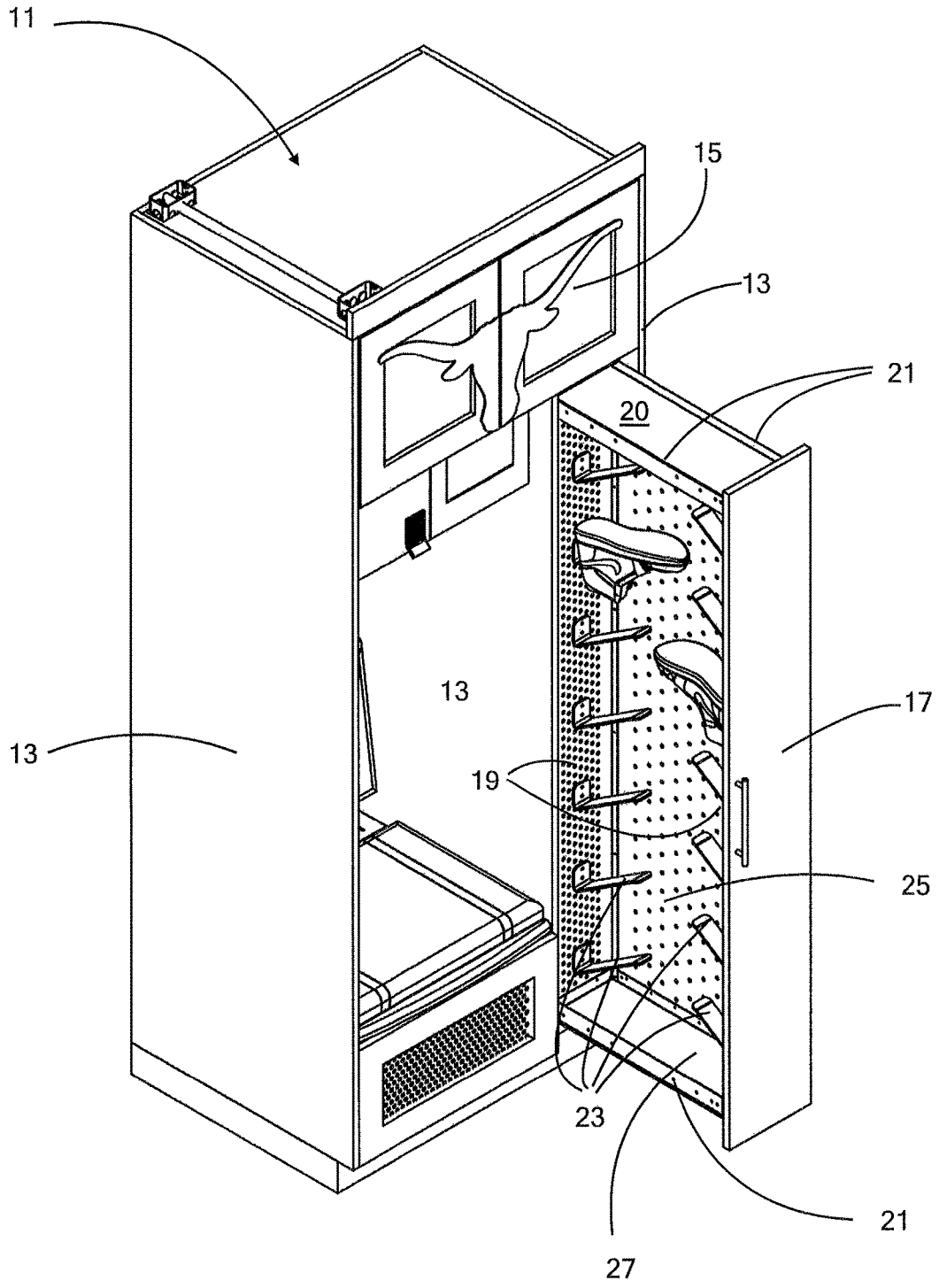
FIG. 3 is an isometric view of the locker of FIGS. 1 and 2, showing the shoe storage enclosure according to the present application.

As shown in FIGS. 2 and 3, a plurality of pairs of generally opposed or opposing projections 23, dimensioned, configured, and adapted to be inserted into the interior of sport or athletic shoes, as illustrated, are secured to end walls 19 in a slightly staggered fashion. Projections 23 serve to temporarily secure and support shoes in a storage position within compartment 17. Projections 23 may be formed of sheet stainless steel, bent at an included angle of approximately 45-60 degrees, with a vertical portion riveted or screwed or otherwise fastened to endwalls 19. Projections 23 may be shorter or longer than illustrated to accommodate different sizes or types of shoes (e.g. provided with notches for "flip flops," or shaped differently to accommodate boots or other high-topped shoes) and to accommodate gloves (with or without individual finger projections). Projections 23 may be provided with electric resistance or other heating elements to assist drying of shoes. Projections 23 may be provided with anti-odor, anti-fungal, or anti-bacterial coatings (or receptacles for such inserts) to prevent odor or infections. Projections 23 may also be adjustable as to length or angle via hinges and other mechanisms so that they can be customized to accommodate different types of shoes, gloves, and the like. Projections 23 may also be hollow and connected to a forced-air ventilation system to provide additional air circulation within the shoes.

At least one side of compartment 17 must be open in the open position to permit access to projections 23. A perforated stainless steel back wall 25 may extend between end walls 19 to add strength to enclosure or compartment 17. The perforations permit air circulation to allow stored shoes to dry. Some lockers 11 may be provided with forced-air ventilation (either wholly or partially self-contained or coupled to building HVAC) for various compartments, including compartment 17. Such ventilation may include anti-odor, anti-fungal, or anti-bacterial treatments. A removable debris tray 27 may be disposed at the bottom of enclosure 17 to catch mud, grass and other debris from shoes stored in enclosure 17. Tray 27 may be removed and debris emptied and replaced.

In operation, the locker user pulls shoe compartment 17 from the stored, closed, or retracted position into the open or extended position and places recently worn, dirty, and/or sweaty or otherwise wet shoes onto projections 23. Compartment 17 then may be closed, where the shoes will dry. Any dried mud or grass or other debris falling from shoes will land on tray 27, which may be removed for disposal of the debris.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

I claim:

1. An enclosure in a locker for the storage of shoes, comprising:

a pair of spaced-apart, generally opposing end walls;

a pair of first projections mounted respectively on the end walls, each end wall carrying its respective first projection distinctly from the other end wall and the other first projection, each first projection dimensioned and configured to be inserted into the interior of one of a pair of shoes to temporarily secure each shoe in a fixed position relative to the end wall; and a bottom extending between the end walls, the bottom including a removable tray to catch debris falling from the shoes;

wherein the removable tray is open to the entire enclosure;

wherein each first projection is formed of a flat planar member having one bend, each first projection having a first flat portion and a second flat portion, the first flat portion being mounted to and extending down the respective end wall such that the bend is placed adjacent to the end wall and extends from the bottom of the first flat portion, the second flat portion extending upwards from the bend and away from the respective end wall;

wherein the second flat portion of each first projection extends from its respective first flat portion at an acute angle such that each first projection holds its respective shoe in an upside-down position relative to the bottom of the enclosure;

wherein the enclosure is selectively moveable into and out of a correspondingly shaped recess in the locker between a stored position and an extended position;

wherein a first side of the enclosure is open and the opposing side of the enclosure remains covered by a back wall when the enclosure is in the extended position;

and wherein the enclosure is perforated with apertures that pass through in at least a portion of the back wall and at least one of the end walls such that ventilation flows through the back wall and the perforated end wall.

2. The enclosure of claim 1, further comprising:

a top wall connecting the end walls at upper ends thereof to define a generally rectilinear assembly with the end walls and bottom.

3. The enclosure of claim 1, further comprising:

a pair of second projections mounted respectively on the end walls, each end wall carrying its respective second projection distinctly from the other end wall and the other second projection;

wherein two pairs of shoes are stored in the enclosure.

4. The enclosure of claim 3, wherein all of the projections are aligned along a vertical plane perpendicular to the end walls.

5. The enclosure of claim 1, further comprising:

a pair of glove projections disposed in the enclosure, each of the glove projections being dimensioned and configured to be inserted into one of a pair of gloves.

6. The enclosure of claim 1, wherein the enclosure is mounted on rails for sliding movement into and out of the recess.

7. A portion of retractable shoe storage rack in a locker, comprising:

a pair of spaced-apart, generally opposing and generally vertical end walls;

a top and a bottom, each extending between the end walls at a top and bottom thereof, respectively, the end walls, top and bottom defining an enclosure, the enclosure being selectively movable into and out of a recess in the locker between a stored position and an extended position;

a fixed back wall extending between at least the end walls;

a pair of first projections mounted respectively on the end walls, each end wall carrying its respective first projection distinctly from the other end wall and the other first projection, each first projection dimensioned and configured to be inserted into the interior of one of a pair of shoes to temporarily secure each shoe in a fixed position relative to the end wall; and a removable tray disposed between the end walls and proximal to the bottom to catch debris falling from the shoes;

wherein the removable tray is open to the entire enclosure;

wherein each first projection is formed of a flat planar member having one bend, each first projection having a first flat portion and a second flat portion, the first flat portion being mounted to and extending down the respective end wall such that the bend is placed adjacent to the end wall and extends from the bottom of the first flat portion, the second flat portion extending upwards from the bend and away from the respective end wall;

wherein the second flat portion of each first projection extends from its respective first flat portion at an acute angle such that each first projection holds its respective shoe in an upside-down position relative to the bottom of the enclosure;

and wherein the enclosure is perforated in the fixed back wall and at least a portion of at least one of the end walls for ventilation.

8. The locker portion of claim 7, further comprising:

a pair of second projections mounted respectively on the end walls, each end wall carrying its respective second projection distinctly from the other end wall and the other second projection;

wherein two pairs of shoes are stored in the enclosure.

9. The enclosure of claim 8, wherein all of the projections are aligned along a vertical plane perpendicular to the end walls.

10. The locker portion of claim 7, further comprising:

a pair of glove projections disposed in the enclosure, each of the glove projections being dimensioned and configured to be inserted into one of a pair of gloves.

11. The locker portion of claim 7, wherein the rack is mounted on rails for sliding movement into and out of the recess.

12. A locker, comprising:

a pair of spaced-apart, generally vertical locker side walls;

a locker top and a locker bottom, each extending respectively between the locker side walls;

a sliding enclosure, the sliding enclosure comprising:

a pair of spaced-apart, generally opposing and generally vertical end walls, the end walls being perpendicular to the locker side walls;

an enclosure top and an enclosure bottom, each extending between the end walls at a top and bottom thereof, respectively;

an enclosure back wall fixed between the end walls and extending along a first side of the enclosure;

a pair of first projections mounted on respective end walls and generally opposing each other, each first projection being a flat planar member having one bend, each first projection having a first flat portion and a second flat portion, each respective first flat portion is placed adjacent to its respective end wall such that the bend is placed adjacent to the respective end wall and extends from a bottom of the first flat portion, each respective second flat portion extending upwards from the bend at an acute angle from the first flat portion and away from its respective end wall into the enclosure opposite the other first projection; and a pair of second projections mounted on respective end walls and generally opposing each other, each second projection being a flat planar member, each second projection being distinctly mounted on its respective end wall and extending into the enclosure opposite the other second projection;

wherein the sliding enclosure is mounted on drawer slides, such that the sliding enclosure selectively slides into and out of an enclosure recess between a stored position and an extended position;

and wherein the enclosure back wall and at least one of the end walls are perforated with apertures that pass through for ventilation such that ventilation flows through the back wall and the perforated end wall.

13. The locker according to claim 12, further comprising:

wherein the height of the sliding enclosure is less than the vertical distance between the locker top and the locker bottom.

14. The locker according to claim 12, further comprising:

a horizontal shelf extending at least partially between the locker side walls above the locker bottom and beneath the locker top; and a vertical interior sidewall extending vertically between the horizontal divider and the locker bottom; and a recessed area defined by the horizontal shelf, the locker bottom, the vertical interior sidewall, and one of the locker side walls;

wherein the sliding enclosure is stored in the recessed area while in the stored position.

15. The locker according to claim 12, further comprising:

a removable tray carried by the enclosure bottom.

16. The locker according to claim 12, wherein the enclosure back wall is formed of stainless steel.

* * * * *